US007594360B2

(12) United States Patent
Silberman et al.

(10) Patent No.: US 7,594,360 B2
(45) Date of Patent: Sep. 29, 2009

(54) LATERAL RELEASE MECHANISM FOR MOVABLE ROOF PANELS

(75) Inventors: Cyril Silberman, Minnetonka, MN (US); Barton L. Riberich, Brooklyn Park, MN (US); Lennart Nielsen, Edina, MN (US); Michael Becker, New Hope, MN (US); Alan Wilcox, Rogers, MN (US); Timothy J. Kline, Minnetonka, MN (US); Neil Tolin, Buffalo, MN (US); Mark Silvera, Crystal, MN (US); Randy Grems, Fairbault, MN (US)

(73) Assignee: Uni-Systems, LLC, Minneapolis, MN (US)

( * ) Notice: Subject to any disclaimer, the term of this patent is extended or adjusted under 35 U.S.C. 154(b) by 144 days.

(21) Appl. No.: 11/367,564

(22) Filed: Mar. 3, 2006

(65) Prior Publication Data

US 2007/0017164 A1 Jan. 25, 2007

Related U.S. Application Data

(60) Provisional application No. 60/659,848, filed on Mar. 9, 2005.

(51) Int. Cl.
*E04B 1/346* (2006.01)
*E04B 7/16* (2006.01)

(52) U.S. Cl. ..... 52/66; 52/6; 52/64

(58) Field of Classification Search ..... 52/6, 52/64, 66; 472/92

See application file for complete search history.

(56) References Cited

U.S. PATENT DOCUMENTS 2,052,217 A 8/1936 Sibour et al.
2,603,171 A 7/1952 Smith
2,642,162 A 6/1953 Tobias
3,009,211 A 11/1961 Hansen et al.
3,135,296 A * 6/1964 Kelstrom et al. ..... 138/122

(Continued)

FOREIGN PATENT DOCUMENTS

JP 2-217539 A 8/1990

(Continued)

*Primary Examiner*—Richard E Chilcot, Jr.
*Assistant Examiner*—Chi Q Nguyen
(74) *Attorney, Agent, or Firm*—Knoble Yoshida & Dunleavy, LLC

(57) ABSTRACT

A movable roof member includes a transport mechanism that is constructed and arranged to permit the roof member to move in a predetermined path with respect to the underlying structure of the supporting edifice. The transport mechanism includes structure for supporting both ends of the roof member, which bridges an otherwise open area of the edifice. In order to permit some flexure and movement of the roof member with respect to the underlying edifice, as will inevitably occur as a result of natural forces such as winds, a lateral release system is provided for maintaining the transport mechanism in a predetermined orientation while simultaneously permitting a limited amount of movement of the roof member in a direction that is nonparallel to the predetermined path of movement. The lateral release system has been found to be most effective when it is provided at but one end of the roof member. The lateral release system preferably includes a linear slide bearing that in the preferred embodiment has a longitudinal axis that is oriented so as to be substantially perpendicular to the predetermined path of travel of the roof member.

21 Claims, 4 Drawing Sheets

U.S. PATENT DOCUMENTS 3,213,571 A 10/1965 Olson
3,261,133 A * 7/1966 Herr et al. ..... 296/213
3,266,328 A * 8/1966 Rott ..... 74/89.17
3,277,619 A * 10/1966 Miller et al. ..... 52/72
3,288,158 A 11/1966 Gugliotta
3,436,132 A * 4/1969 Wiesler ..... 384/43
3,465,483 A * 9/1969 Miller ..... 52/72
3,534,511 A 10/1970 Cappella
3,579,932 A * 5/1971 Atkinson ..... 52/83
3,608,252 A 9/1971 Bisson
3,766,691 A 10/1973 Ray
4,175,361 A 11/1979 Kumode
4,253,709 A * 3/1981 Teramachi ..... 384/45
4,257,199 A 3/1981 Kuboyama
4,296,974 A * 10/1981 Teramachi ..... 384/45
4,348,833 A 9/1982 Nagoya
4,515,416 A * 5/1985 Teramachi ..... 384/45
4,569,164 A * 2/1986 Dickson ..... 52/64
4,570,392 A * 2/1986 Oltman et al. ..... 52/64
4,581,860 A * 4/1986 Berger ..... 52/63
4,587,775 A 5/1986 Lewis et al.
4,616,451 A 10/1986 Glick
4,676,033 A 6/1987 Allen et al.
4,682,449 A 7/1987 Berger
4,706,419 A 11/1987 Adachi et al.
4,716,691 A 1/1988 Allen et al.
4,716,693 A * 1/1988 Webster ..... 52/64
4,727,688 A 3/1988 Kida et al.
4,738,057 A 4/1988 Logan
4,751,800 A 6/1988 Kida et al.
4,802,314 A 2/1989 Schildge, Jr.
4,831,792 A * 5/1989 Berger ..... 52/66
4,833,837 A 5/1989 Bonneau
4,920,707 A 5/1990 Moskuliuk et al.
4,936,060 A 6/1990 Gelinas et al.
4,942,698 A 7/1990 Kumagai
4,995,203 A 2/1991 Brisbin et al.
5,007,214 A 4/1991 Itami et al.
5,010,695 A 4/1991 Schildge, Jr.
5,027,565 A 7/1991 Sugizaki
5,035,093 A 7/1991 Parazader et al.
5,058,332 A 10/1991 Masuyama et al.
5,062,243 A 11/1991 Kumagai
5,063,730 A * 11/1991 Muramoto et al. ..... 56/66
5,070,659 A * 12/1991 Brisbin et al. ..... 52/6
5,103,600 A 4/1992 Geiger et al.
5,115,127 A * 5/1992 Bobb et al. ..... 250/227.19
5,117,594 A 6/1992 Muramoto et al.
5,167,097 A 12/1992 Robbie et al.
5,187,894 A 2/1993 Ripley, Sr. et al.
5,189,851 A * 3/1993 Omika et al. ..... 52/66
5,203,125 A 4/1993 Sugizaki
5,257,481 A 11/1993 Reppas et al.
5,257,485 A 11/1993 Kawaguchi et al.
5,355,641 A * 10/1994 Levy ..... 52/66
5,371,983 A 12/1994 Kawaguchi et al.
5,394,659 A * 3/1995 Kawaguchi et al. ..... 52/66
5,394,660 A 3/1995 Haris
5,522,192 A * 6/1996 Frantl et al. ..... 52/206
5,622,013 A * 4/1997 Ban et al. ..... 52/83
5,640,768 A * 6/1997 Teramachi ..... 29/898.03
5,653,066 A 8/1997 Schildge, Jr.
5,682,711 A 11/1997 Warczak
5,746,028 A 5/1998 DiBenedetto
5,778,603 A 7/1998 Reppas
5,848,499 A * 12/1998 Schildge, Jr. ..... 52/66
5,857,294 A * 1/1999 Castro ..... 52/81.2
5,896,708 A 4/1999 Doi et al.
5,904,003 A * 5/1999 Stephen ..... 52/6
5,927,022 A 7/1999 Hirakawa et al.
5,983,575 A * 11/1999 Reppas ..... 52/66
6,003,269 A * 12/1999 McRee ..... 52/6
6,082,053 A * 7/2000 Bischof et al. ..... 52/64
6,082,054 A * 7/2000 Silberman et al. ..... 52/66
6,145,254 A * 11/2000 Silva ..... 52/66
6,274,813 B1 * 8/2001 Houte et al. ..... 174/68.3
6,367,206 B1 * 4/2002 Silberman et al. ..... 52/66
6,385,912 B1 * 5/2002 Wessel et al. ..... 52/6
6,415,556 B1 * 7/2002 Silberman et al. ..... 52/66
6,698,141 B2 * 3/2004 Silberman et al. ..... 52/6
6,718,696 B2 * 4/2004 Silberman et al. ..... 52/6
6,754,994 B2 * 6/2004 Jahanpour ..... 52/66
6,789,360 B2 * 9/2004 Silberman et al. ..... 52/66
6,851,227 B1 * 2/2005 Schildge, Jr. ..... 52/66

FOREIGN PATENT DOCUMENTS

JP 2-269237 A 11/1990
JP 3-115632 A 5/1991
JP 4-323446 A 11/1992
NL 8006712 7/1982

* cited by examiner

LATERAL RELEASE MECHANISM FOR MOVABLE ROOF PANELS

This application claims priority under 35 USC § 119(e) based on U.S. Provisional Application Ser. No. 60/659,848, filed Mar. 9, 2005, the entire disclosure of which is hereby incorporated by reference as if set forth fully herein.

BACKGROUND OF THE INVENTION

1. Field of the Invention

This invention pertains, in general, to the field of retractable covers or roofs for large structures, such as athletic stadiums. More specifically, the invention relates to an improved transport mechanism for such a structure that is more compact, reliable, stable, mechanically simple and inexpensive to construct than comparable mechanisms heretofore known.

2. Description of the Related Technology

It is common these days for athletic stadiums to be constructed with retractable roofs, because this type of construction offers spectators the pleasure of being outdoors on pleasant days, while providing shelter when necessary against extreme temperatures and inclement weather conditions. In addition, retractable roof construction permits the use of natural grass in a stadium, which is important to many athletes.

A number of factors must be taken into account in the design of a stadium that has a retractable roof. For instance, the forces created by the exertion of natural forces such as wind, rain snow and even earthquakes on such a large structure can be significant and unpredictable, and the roof, the underlying stadium structure and the transport mechanism that is used to guide and move the roof between its retracted and operational positions must be engineered to withstand the worst possible confluence of such forces. In addition, for reasons that are both aesthetic and practical, it is desirable to make the structural elements of the roof and the transport mechanism to be as unobtrusive and as space-efficient as possible. It is desirable to make the roof structure and the transport mechanism to be as simple and maintenance-free as possible, and to be constructed so as to be able to open and close as quickly as possible.

Many cities in the United States and elsewhere are now using or building convertible stadiums that have retractable roof panels. The designs of the various stadiums that have been built and proposed are quite different, but there are a number of deficiencies that seem to be common to many of the designs that have been implemented thus far. For example, the transport mechanisms in most of the stadiums tend to be quite large, being as much as twenty to thirty feet in height. The transport mechanisms further tend to include a relatively small number of very large, heavily loaded wheels and bearings, and a small number of very large motors or actuators to drive the roof between the retracted and operational positions. The small number of large wheels exert very large concentrated loads onto the support structure, which requires the support structure to be heavily reinforced, adding to the cost and complexity of the stadium as a whole. The roof and transport mechanisms in existing designs further tend to be relatively heavy and inflexible, and often experience alignment problems during movement. While many of these problems have been eliminated through the efforts of Uni-Systems, LLC, as is described in U.S. Pat. Nos. 6,082,054; 6,367,206; and 6,415,556, all to Silberman et al., the disclosures of which are hereby incorporated as if set forth fully herein, additional improvements are possible and are sought after by Uni-Systems, Inc. and others.

When large retractable roofs are built onto stadiums, shipyards or other large buildings, it is difficult to establish two perfectly parallel raceways or tracks on which the roof will rest and travel. The difficulty is trying to get the two tracks perfectly parallel. There are a number of reasons why they may vary in width, including (1) variation from the construction itself; (2) variation from expansion and contraction of the building foundations and walls; (3) variation from external wind forces and/or ice and snow that might develop on one side or the other of the wall; (4) variation from the retractable roof itself which is the result of expansion and contraction from thermal variations; (5) variation from dead-load camber from within the spanning truss and/or (6) variations from racking. It is very difficult to keep a square or rectangular roof perfectly square as it travels down a pair of tracks; this tends to create variable dimensions. The inventors have determined that all of these variations can be accommodated by a properly designed and constructed lateral or horizontal release mechanism.

U.S. Pat. No. 6,415,556 to Silberman et al. discloses a system having a four bar linkage as orientation structure for maintaining the transport mechanism in a predetermined orientation while permitting a limited amount of movement of the roof member in a direction that is nonparallel to the direction of transport. The four-bar linkage does a good job of providing this orientation function if there is sufficient vertical height within the retractable roof to accommodate the four-bar linkage. Key to any orientation mechanism is its ratio of horizontal drag as compared to the vertical gravity component.

For example, if a roof weighs 1,000 tons then the reaction if the sidewall desires to move will be restrained by the coefficient of friction of whatever lateral release mechanism has been utilized. In the case of the four-bar linkage, as long as the linkage bars are exactly straight, up and down vertical, aligned with gravity, the resulting side force from the 1,000 ton roof would be zero. However, as soon as either the roof expands, or the wall line contracts, an angle develops between the four-bar linkage struts. While the struts remain parallel they become tilted when compared to a straight line aligned with gravity. This tilt results in a horizontal thrust or reaction. That reaction becomes more severe as the displacement continues to grow. At some point the angle of the parallel bar linkage becomes too great and the horizontal thrust on the wall and/or roof becomes unacceptably high. The only way to correct this with a four-bar linkage is to extend the length of the parallel bars, which in some cases is objectionable for architectural reasons and the simple geometry of the installation. Accordingly, on many roofs there just isn't sufficient room to use the parallel bar or four-bar linkage orientation system.

A need exists for an improved design for a retractable roof and transport mechanism that is compact, lightweight and mechanically simple, and that is capable of maintaining its stability and alignment during normal use and in extreme conditions more capably than comparable mechanisms heretofore known.

SUMMARY OF THE INVENTION

Accordingly, it is an object of the invention to provide an improved design for a retractable roof and transport mechanism that is compact, lightweight and mechanically simple, and that is capable of maintaining its stability and alignment during normal use and in extreme conditions more capably than comparable mechanisms heretofore known.

In order to achieve the above and other objects of the invention, a system for supporting a large overhead structural member for stable movement with respect to an underlying structure according to a first aspect of the invention includes a transport mechanism that is constructed and arranged to permit the large overhead structural member to move in a predetermined path with respect to the underlying structure; and a lateral release system for maintaining the transport mechanism in a predetermined orientation while simultaneously permitting a limited amount of movement of the large overhead structural member in a direction that is nonparallel to the predetermined path, the lateral release system comprising a linear slide bearing.

A large edifice having a retractable roof includes, according to a second aspect of the invention, an area to be covered; a stationary roof structure over the area; a large, heavy roof movable roof panel mounted for movement with respect to said stationary roof structure; a transport mechanism that is constructed and arranged to permit the movable roof panel to move in a predetermined path with respect to the underlying structure; and a lateral release system for maintaining the transport mechanism in a predetermined orientation while simultaneously permitting a limited amount of movement of the movable roof panel in a direction that is nonparallel to the predetermined path, the lateral release system comprising a linear slide bearing.

According to a third aspect of the invention, a convertible stadium having a retractable roof includes a playing field; a spectator area; a stationary roof structure; a large, heavy roof movable roof panel mounted for movement with respect to the stationary roof structure; a transport mechanism that is constructed and arranged to permit the movable roof panel to move in a predetermined path with respect to the underlying structure; and a lateral release system for maintaining the transport mechanism in a predetermined orientation while simultaneously permitting a limited amount of movement of the movable roof panel in a direction that is nonparallel to the predetermined path, the lateral release system comprising a linear slide bearing.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
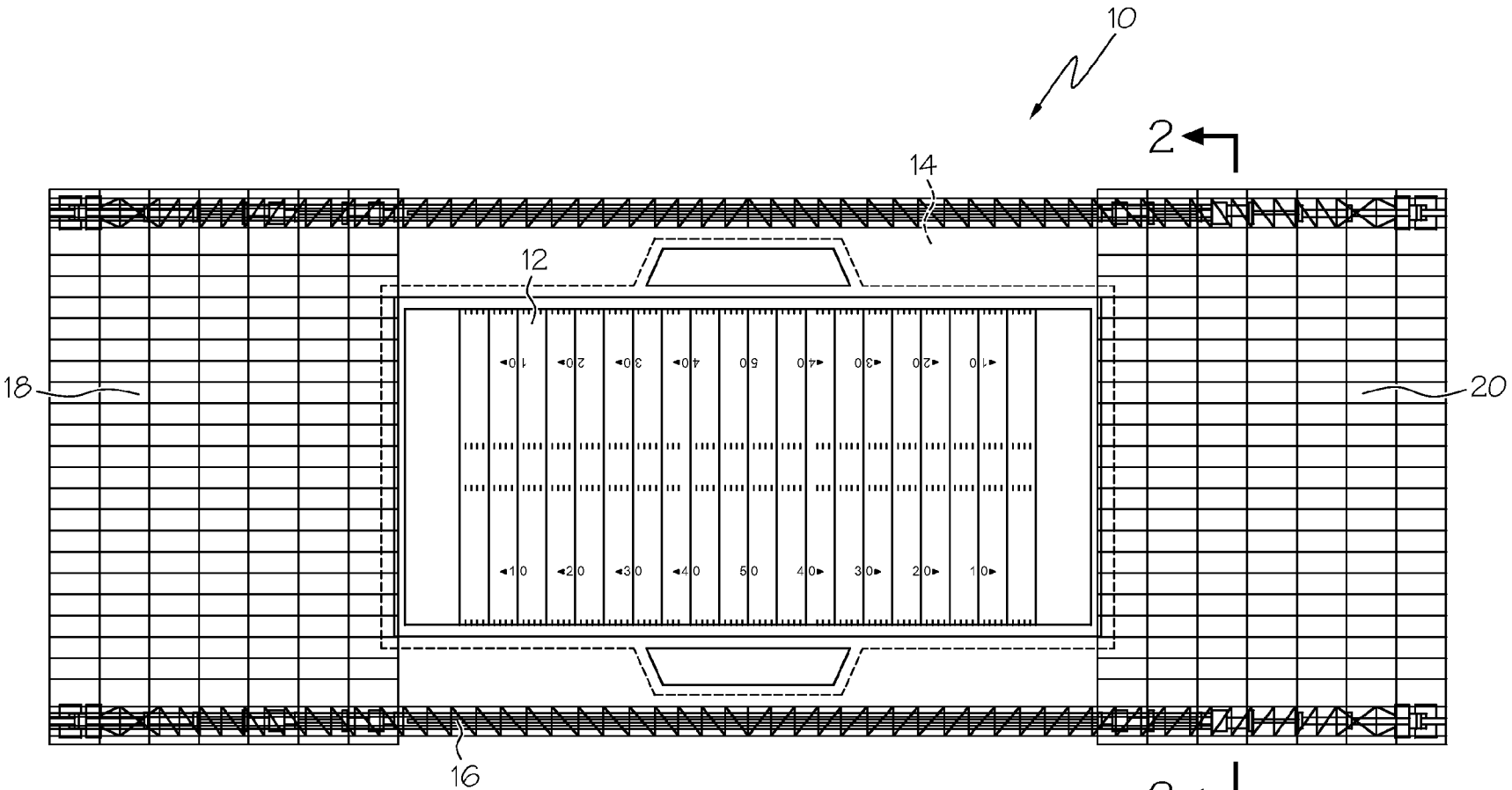
FIG. 1 is a top plan view of the convertible stadium constructed according to a preferred embodiment of the invention.

Referring now to the drawings, wherein like reference numerals designate corresponding structure throughout the views, and referring in particular to FIG. 1, a convertible stadium 10 that is constructed according to a preferred embodiment of the invention includes a playing field 12 which in the preferred embodiment is an American football field, and a seating area 14 for spectators. Convertible stadium 10 is preferably what is generally considered to be a large stadium, i.e. a stadium that can accommodate over 40,000 spectators and that is suitable for professional sporting events such as National Football League games. The term "large edifice" is defined herein as an edifice that is over 15,000 square feet.

Convertible stadium 10 further preferably includes stationary roof structure 16, a first movable roof panel 18 and a second movable roof panel 20. The first and second movable roof panels 18, 20 are large, relatively heavy structures in engineering terms, having a length and a width of at least 100 feet in each dimension and a weight of at least 100 tons. Preferably, both the first and second movable roof panels 18, 20 are constructed as a lenticular truss as taught in U.S. Pat. No. 4,789,360 to Silberman et al., the disclosure of which is incorporated by reference as if set forth fully herein.

Figure 2:
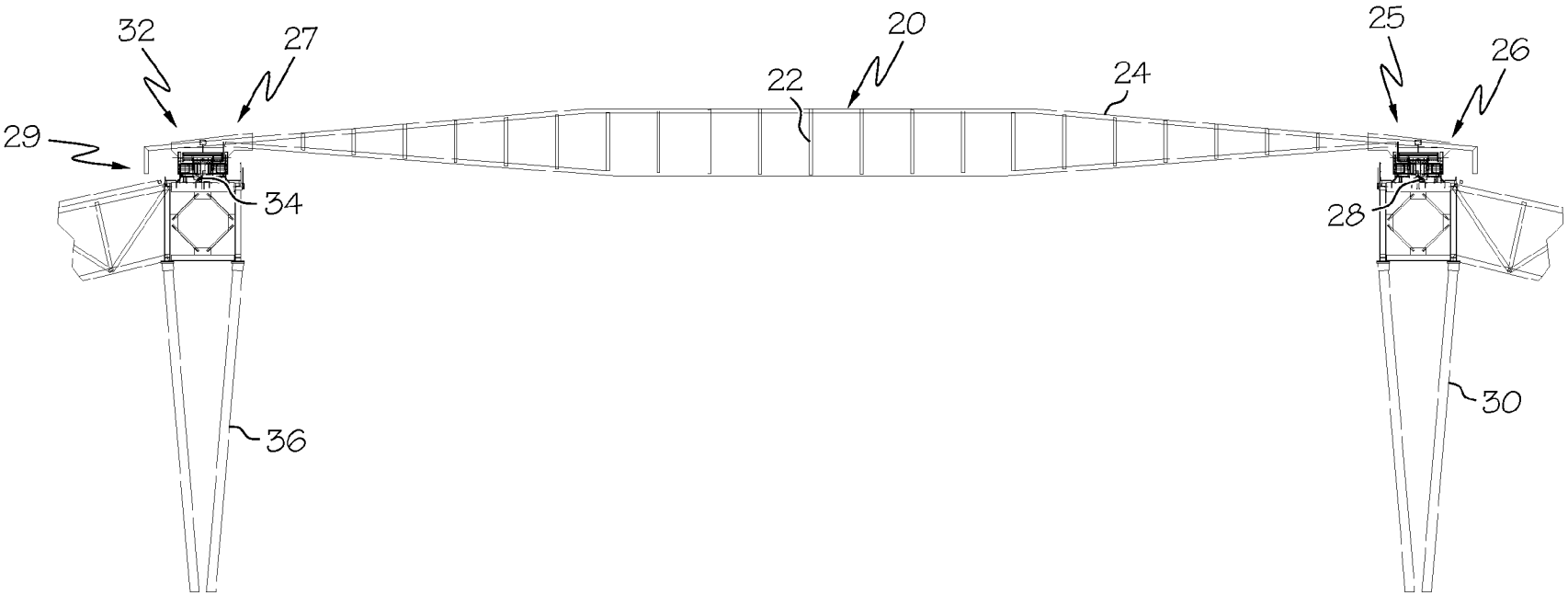
FIG. 2 is a fragmentary cross-sectional view taken along lines 2-2 in FIG. 1.

Referring now to FIG. 2, it will be seen that the second movable roof panel 20 includes an internal lenticular roof truss 22 and an external fabric cover 24. Second movable roof panel 20 is supported at a first end 25 by a first transport mechanism 26 that is mounted for movement along a first predetermined path defined by a trolley rail 28 that is securely mounted to an underlying structural support 30. Second movable roof panel 20 is further supported at a second, opposite end 27 by a second transport mechanism 32 that is mounted for movement along a second predetermined path that is designed to be parallel to the first predetermined path and that is defined by a trolley rail 34 that is securely mounted to an underlying structural support 36. The first end 25 of the second movable roof panel 20 is preferably securely mounted to the first transport mechanism 26, while the second end 27 of the second movable roof panel 20 is provided with a lateral release system 29 that maintains the transport mechanism in a predetermined orientation while simultaneously permitting a limited amount of movement of the movable roof panel and a direction that is nonparallel to the second predetermined path. Lateral release system 29 is preferably embodied as a linear slide bearing, as will be described in greater detail below.

Figure 3:
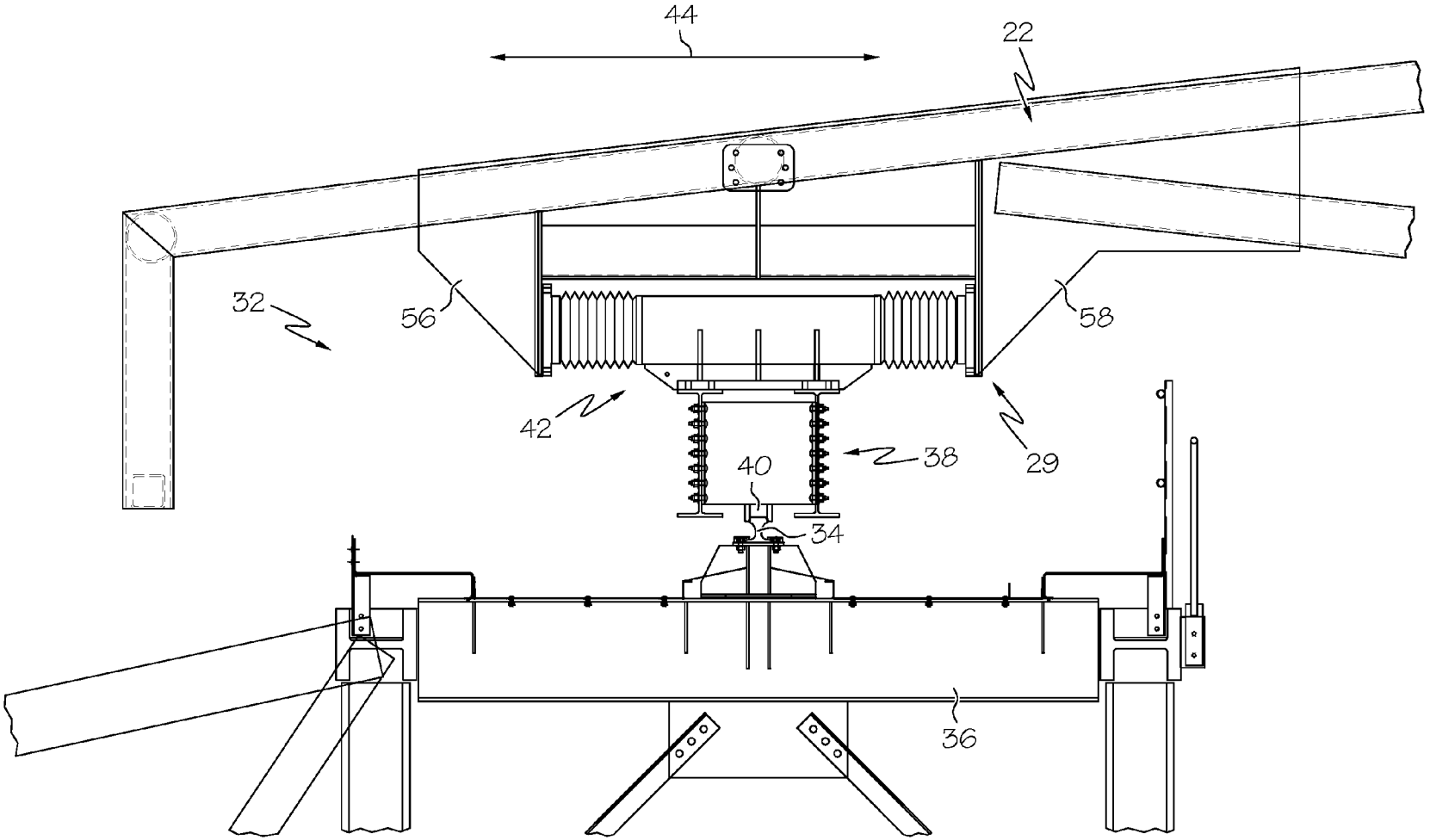
FIG. 3 is a fragmentary cross-sectional view of the portion of the convertible stadium depicted in FIG. 1.

Looking now to FIG. 3, it will be seen that second transport mechanism 32 includes a roof carrier unit 38 that preferably includes a plurality of rail follower wheels 40 and is adapted to ride upon the trolley rail 34. Lateral release system 29 is structurally interposed between the rail follower wheels 40 and the movable roof panel 20, as is clearly shown in FIG. 3. It includes a linear bearing assembly 42 that is adapted to permit limited movement of the second end 27 of the second movable roof panel 20 in a direction that is nonparallel to the transport direction of the movable roof panel 20. In the preferred embodiment, lateral release system 29 and linear bearing assembly 42 permits limited movement of the second end 27 in a direction 44 that is substantially perpendicular to the transport direction of the movable roof panel 20. In other words, the longitudinal axis of the linear bearing assembly 42 is preferably substantially perpendicular to the predetermined path of travel of the movable roof panel 20. As FIG. 3 clearly shows, the transport mechanism 32 includes a single trolley rail 34 on the underlying structure with no additional rail and a plurality of rail follower wheels 40 on the large overhead structural member that are adapted to ride on the single trolley rail 34.

Figure 4:
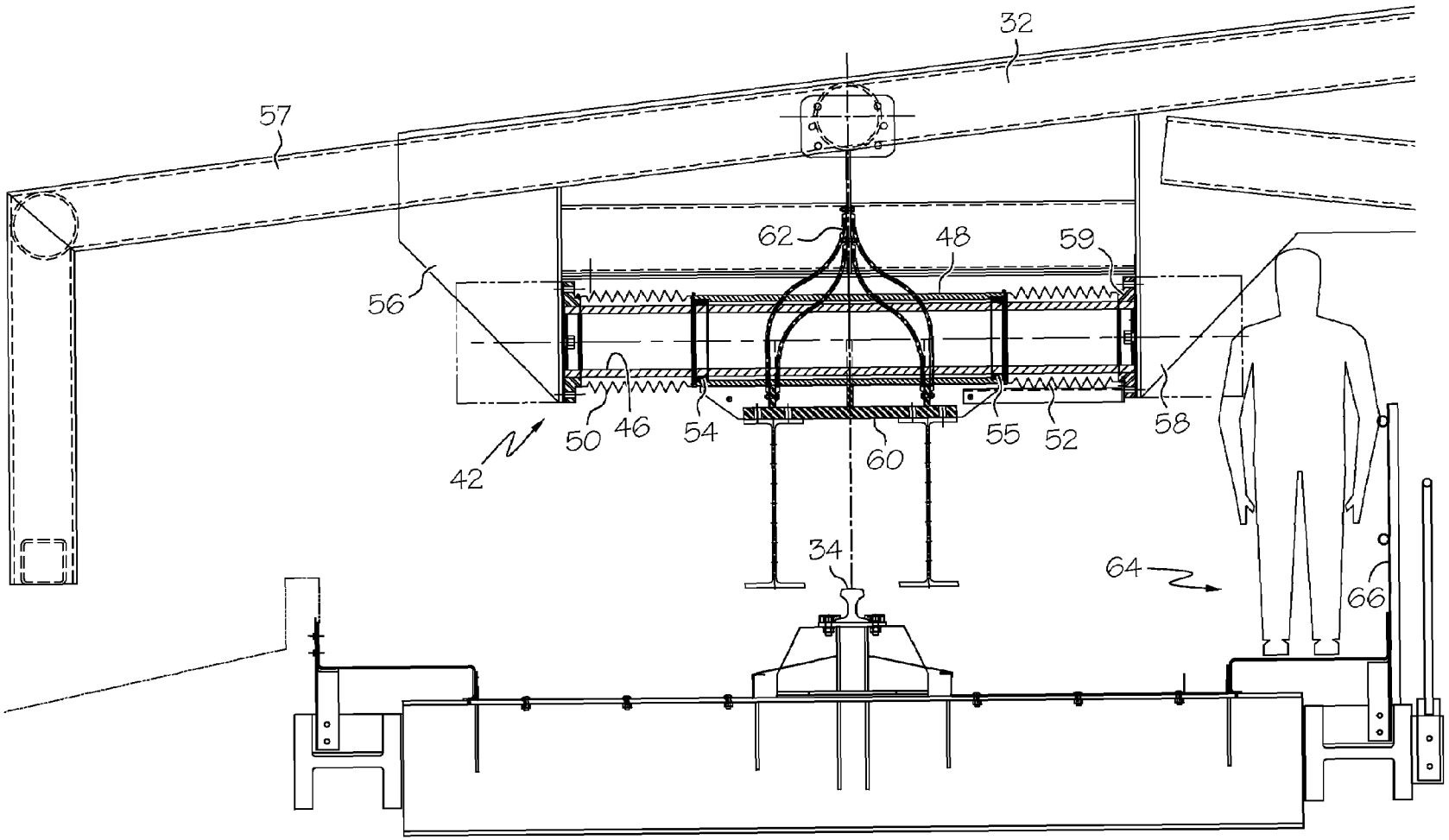
FIG. 4 is a fragmentary cross-sectional view of the portion of the convertible stadium depicted in FIG. 1, with certain elements omitted for clarity.

Referring briefly to FIG. 4, it will be seen that linear bearing assembly 42 includes a cylindrical guide shaft 46, which is oriented in a substantially horizontal position for movement within a cylindrical guide shaft collar 48. Cylindrical guide shaft 46 is preferably a 1026 hot finished seamless steel tube that is turned and polished and then finished with an electroless nickel plating. First and second flexible boots 50, 52 are provided that extend over portions of the guide shaft 46 that protrude upwardly from each end of the guide shaft collar 48. The purpose of the first and second flexible boots 50, 52 is to protect the guide shaft 46 and the rest of the linear bearing assembly 42 against contamination from the environment. Bearing sleeves 54, 55 are interposed between the guide shaft collar 48 and the guide shaft 46 at each end of the guide shaft collar 48 for providing a bearing surface to permit sliding movement of the guide shaft 46 with respect to the guide shaft collar 48. Bearing sleeves 54, 55 are preferably fabricated from a fiberglass epoxy composite with a polytetrafluoroethylene (PTFE) fabric inner liner, and are commercially available under the trade name DURALON from Rexnord Corporation.

An outer mounting bracket 56 is provided to securely mount a first distal end 57 of the cylindrical guide shaft 46 to the lenticular roof truss 22. An inner mounting bracket 58 securely mounts a second distal end of the cylindrical guide shaft 46 to the lenticular roof truss 22. A mounting flange 60 that is securely welded to the guide shaft collar 48 is securely fastened to the roof carrier unit 38, as is best shown in FIG. 3. In order to prevent lightning from damaging the linear bearing assembly 42, a lightning shunt 62 is provided to redirect electricity from the lenticular roof truss 22 to the mounting flange 60. A walkway 64 having a guard rail 66 is provided adjacent to the linear bearing assembly 42 in order to permit maintenance personnel to gain access to the linear bearing assembly 42 and to the transport mechanism 32.

Preferably, the linear bearing assembly 42 is constructed so as to be operative at a frictional ratio of 20% or less of the weight being applied thereto by the lenticular roof truss 22 during operation. More preferably, linear bearing assembly 42 operates at a frictional ratio of 15% or less, and most preferably at a frictional ratio of 10% or less. Linear bearing assembly 42 is preferably constructed so as to be operative at weight loads within a range of about 40 kips to about 260 kips.

This lateral release mechanism is an improvement over the four-bar linkage and all other systems that have been used to date. This system is unique because it reduces the ratio of horizontal friction to vertical gravity, thus transmitting a very small side-load to the wheels and bearings for the main load supporting wheels on the main rails. It also reduces the amount of space that is required for the lateral release mechanism.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. The system for supporting a large overhead structural member for stable movement with respect to an underlying structure, comprising:

first and second transport mechanisms, each of which is constructed and arranged to permit the large overhead structural member to move in a predetermined path with respect to the underlying structure, said transport mechanism comprising a single trolley rail on the underlying structure with no additional rail and a plurality of rail follower wheels on the large overhead structural member that are adapted to ride on said single trolley rail; and a lateral release system for each of said transport mechanism, interposed between said rail follower wheels and the large overhead structural member, for maintaining the transport mechanism in a predetermined orientation while simultaneously permitting a limited amount of movement of the large overhead structural member in a direction that is nonparallel to said predetermined path, wherein said system transmits a very small side load to said single trolley rail with no need for additional lateral reinforcement, said lateral release system comprising a linear slide bearing.

2. The system according to claim 1, wherein said lateral release system is configured so that said linear slide bearing has a longitudinal axis that is oriented so as to be substantially perpendicular to said predetermined path.

3. The system according to claim 1, wherein said linear slide bearing is constructed and arranged to operate at a frictional ratio of 20% or less.

4. The system according to claim 3, wherein said linear slide bearing is constructed and arranged to operate at a frictional ratio of 15% or less.

5. The system according to claim 4, wherein said linear slide bearing is constructed and arranged to operate at a frictional ratio of 10% or less.

6. The system according to claim 1, wherein said linear slide bearing comprises a PTFE material.

7. The system according to claim 1, wherein said linear slide bearing is constructed and arranged to operate at weight loads within a range of 40 kips to about 260 kips.

8. The system according to claim 1, further comprising an electrical shunt for protecting said linear slide bearing against lightning.

9. The system according to claim 1, further comprising a flexible boot for protecting said linear slide bearing against contamination.

10. The system according to claim 1, further comprising a walkway for permitting maintenance access to said lateral release system.

11. The large edifice according to claim 1, wherein said linear slide bearing is constructed and arranged to operate at a frictional ratio of 20% or less.

12. The large edifice according to claim 11, wherein said linear slide bearing is constructed and arranged to operate at a frictional ratio of 15% or less.

13. The large edifice according to claim 12, wherein said linear slide bearing is constructed and arranged to operate at a frictional ratio of 10% or less.

14. A large edifice having a retractable roof, comprising:

an area to be covered;

a stationary roof structure over the area;

a large, heavy roof movable roof panel mounted for movement with respect to said stationary roof structure;

first and second transport mechanisms, each of which is constructed and arranged to permit the movable roof panel to move in a predetermined path with respect to the underlying structure, said transport mechanism comprising a single trolley rail on the underlying structure with no additional rail and a plurality of rail follower wheels on the large overhead structural member that are adapted to ride on said single trolley rail; and a lateral release system for each of said transport mechanism, interposed between said rail follower wheels and the movable roof panel, for maintaining the transport mechanism in a predetermined orientation while simultaneously permitting a limited amount of movement of the movable roof panel in a direction that is nonparallel to said predetermined path, wherein said system transmits a very small side load to said single trolley rail with no need for additional lateral reinforcement, said lateral release system comprising a linear slide bearing.

15. The large edifice according to claim 14, wherein said lateral release system is configured so that said linear slide bearing has a longitudinal axis that is oriented so as to be substantially perpendicular to said predetermined path.

16. The large edifice according to claim 14, wherein said linear slide bearing comprises a PTFE material.

17. The large edifice according to claim 14, wherein said linear slide bearing is constructed and arranged to operate at weight loads within a range of 40 kips to about 260 kips.

18. The large edifice according to claim 14, further comprising an electrical shunt for protecting said linear slide bearing against lightning.

19. The large edifice according to claim 14, further comprising a flexible boot for protecting said linear slide bearing against contamination.

20. The large edifice according to claim 14, further comprising a walkway for permitting maintenance access to said lateral release system.

21. A convertible stadium having a retractable roof, comprising:

a playing field;

a spectator area;

a stationary roof structure;

a large, heavy roof movable roof panel mounted for movement with respect to said stationary roof structure;

first and second transport mechanisms, each of which is constructed and arranged to permit the movable roof panel to move in a predetermined path with respect to the underlying structure, said transport mechanism comprising a single trolley rail on the underlying structure with no additional rail and a plurality of rail follower wheels on the large overhead structural member that are adapted to ride on said single trolley rail; and a lateral release system for each of said transport mechanism, interposed between said rail follower wheels and the movable roof panel, for maintaining the transport mechanism in a predetermined orientation while simultaneously permitting a limited amount of movement of the movable roof panel in a direction that is nonparallel to said predetermined path, wherein said system transmits a very small side load to said single trolley rail with no need for additional lateral reinforcement, said lateral release system comprising a linear slide bearing.

* * * * *

UNITED STATES PATENT AND TRADEMARK OFFICE

CERTIFICATE OF CORRECTION

PATENT NO. : 7,594,360 B2
APPLICATION NO. : 11/367564
DATED : September 29, 2009
INVENTOR(S) : Silberman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 354 days.

Signed and Sealed this

Twenty-eighth Day of September, 2010

David J. Kappos

David J. Kappos
*Director of the United States Patent and Trademark Office*